US007530764B1

(12) United States Patent
Gallegos

(10) Patent No.: US 7,530,764 B1
(45) Date of Patent: May 12, 2009

(54) EASY CLEAN CULVERT SYSTEM

(76) Inventor: Joe Gallegos, P.O. Box 24, Capulin, CO (US) 81124

( * ) Notice: Subject to any disclaimer, the term of this patent is extended or adjusted under 35 U.S.C. 154(b) by 0 days.

(21) Appl. No.: 12/107,586

(22) Filed: Apr. 22, 2008

Related U.S. Application Data

(60) Provisional application No. 61/012,887, filed on Dec. 11, 2007.

(51) Int. Cl.
*E01F 5/00* (2006.01)

(52) U.S. Cl. ..... 405/126; 405/125

(58) Field of Classification Search ..... 405/124–126
See application file for complete search history.

(56) References Cited

U.S. PATENT DOCUMENTS

| | | | | |
|---|---|---|---|---|
| 928,265 | A | 7/1909 | Mahoney et al. | |
| 1,144,200 | A | 6/1915 | Hewett | |
| 1,612,640 | A | 12/1926 | Morgan | |
| 1,638,428 | A | 8/1927 | Zander | |
| 1,662,714 | A | 3/1928 | Morgan | |
| 1,683,544 | A | 9/1928 | Hansen | |
| 1,846,147 | A | 2/1932 | Rogers | |
| 1,854,815 | A | 4/1932 | Turner | |
| 1,995,716 | A | 3/1935 | Millsom | |
| 1,997,236 | A * | 4/1935 | Schroeder, Jr. | 405/125 |
| 2,041,267 | A | 5/1936 | Schroeder, Jr. | |
| 3,225,545 | A | 12/1965 | Flegel | |
| 4,314,775 | A | 2/1982 | Johnson | |
| 4,386,486 | A * | 6/1983 | Holt et al. | 52/125.5 |
| 4,751,945 | A * | 6/1988 | Williams | 404/2 |
| 4,854,775 | A | 8/1989 | Lockwood | |
| 4,940,359 | A | 7/1990 | Van Duyn et al. | |
| 4,983,070 | A | 1/1991 | Hwang | |
| 5,004,208 | A * | 4/1991 | Domizio | 52/125.4 |
| 5,040,921 | A | 8/1991 | Torok | |
| 5,667,200 | A * | 9/1997 | Kelley, Jr. | 264/219 |
| 5,735,637 | A | 4/1998 | Gunter | |
| 5,803,662 | A * | 9/1998 | Gunter | 405/119 |
| 5,836,717 | A | 11/1998 | Bernini | |
| 5,971,662 | A | 10/1999 | Becker et al. | |
| 6,254,307 | B1 * | 7/2001 | Ragold | 404/4 |
| 6,494,232 | B2 | 12/2002 | Waddleton | |
| 6,698,977 | B1 * | 3/2004 | Charon | 405/118 |
| 6,991,402 | B2 * | 1/2006 | Burkhart | 405/126 |
| 7,137,756 | B1 | 11/2006 | Jones | |
| 2005/0286977 | A1 | 12/2005 | Charon | |

FOREIGN PATENT DOCUMENTS

| | | | |
|---|---|---|---|
| JP | 11190058 | * | 7/1999 |

* cited by examiner

*Primary Examiner*—Frederick L Lagman
(74) *Attorney, Agent, or Firm*—Schmeiser, Olsen & Watts, LLP

(57) ABSTRACT

An easy clean culvert system being formed of concrete, wherein the culvert system includes a plurality of culvert sections, each section having a cover that is removably coupled to a base portion of the culvert section. The cover may be removed and replaced in order to access the culvert system for easy cleaning. The culvert sections are coupled together to form the entire culvert system.

10 Claims, 3 Drawing Sheets

EASY CLEAN CULVERT SYSTEM

CROSS REFERENCE TO RELATED APPLICATION

This application claims priority to U.S. Provisional Patent Application entitled "SPLIT-BOX CULVERT SYSTEM," Ser. No. 61/012,887, filed Dec. 11, 2007, the disclosure of which is hereby incorporated entirely herein by reference.

BACKGROUND OF THE INVENTION

1. Technical Field

This invention relates generally to a culvert system and more particularly to an easy clean culvert system with a removable cover for easy cleaning.

2. State of the Art

A culvert system is a conduit used to allow water to pass underneath a road, railway, embankment, driveway, or sidewalk for example. Culverts are utilized in order to maintain flow of a river, canal or other waterway under a road or other structure, or may be used in order to facilitate draining of water, such as runoff water. Culverts may also be applicable for other uses beyond water flow. Culverts can be made of many different materials, with steel, polyvinyl chloride (PVC) and concrete being of the most common.

Conventional culvert systems include conduits that run under the surface of the ground, such as under a roadway and the like. These conventional culverts are constructed to be installed permanently, without removable parts. They provide a structure for draining of water from one area to another.

These conventional culvert systems have their limitations. For example, culvert systems, due to the intended purpose of culverts, are subject to blockage. Heavy silting and other debris are often products of running water. As the water passes through the culvert system, much of that silting and debris are left within the culvert and eventually, the culverts are rendered inoperable. Conventional culvert systems do not provide a structure for cleaning the culvert system easily and efficiently.

Other limitations that conventional culvert systems include, particularly concrete culvert systems, is the strength of the culvert system and the ability to tolerate large loads on the cover. Further still another limitation is installation of culverts on and in soil with poor compaction or unstable soil. Culvert systems are often damaged due to settling of only a portion of the soil, thereby applying additional shear forces on the culvert and damaging the culvert.

Accordingly, there is a need in the field of culvert systems for an improved easy clean culvert system.

DISCLOSURE OF THE INVENTION

The present invention relates to an easy clean culvert system being formed of concrete, wherein the culvert system includes a plurality of culvert sections, each section having a cover that is removably coupled to a base portion of the culvert section. The cover may be removed and replaced in order to access the culvert system for easy cleaning. The culvert sections are coupled together to form the entire culvert system.

An aspect of the present invention includes an easy clean culvert system which may comprise a plurality of culvert sections, each culvert section having a base portion having a bottom wall and two side walls, wherein the side walls are parallel to each other and transverse to the bottom wall. Each culvert section may also include a cover removably coupled to the base portion, a cover removably coupled to the base portion, wherein the cover is adapted to be repeatable moveable between positions engaged with and disengaged from the side walls. The cover of each culvert section of the culvert system may further include at least one lifting device coupled to the cover, wherein the at least one lifting device provides an interface to lift the cover by use of lightweight equipment. The plurality of sections may be coupled together by use of a tongue and keyway joint, wherein the tongue of one culvert section is coupled to a keyway of another culvert section.

In particular aspects of the present invention, the culvert system may also comprise bearing blocks. The bearing blocks are utilized on unstable or poorly compacted soil. The bearing blocks may be placed under the tongue and keyway joint. The bearing block provides additional support and limits the amount of shear forces applied to the tongue and keyway joint if soil settles unevenly.

In other particular aspects of the present invention, the culvert system may also include headwalls coupled on opposing ends of an assembled culvert system, the headwalls having an extension that extends above the cover to form a curb to prevent additional debris from falling into the culvert system.

Another aspect of the present invention includes an easy clean culvert section comprising at least one culvert section adapted to support at least twenty-five tons. The culvert section comprises a base portion having a bottom wall and two side walls, wherein the side walls are parallel to each other and transverse to the bottom wall; a cover removably coupled to the base portion, wherein the cover is adapted to be removed for cleaning of the culvert section and replaced when cleaning is complete; and lifting devices coupled to the cover adjacent each corner of the cover, wherein the lifting devices are configured as an interface to lift the cover by use of lightweight equipment. The culvert system may further comprise a roadway, wherein a top surface the cover of the culvert section lies substantially within a same plane as the roadway surface.

Further, another aspect of the present invention includes a method of maintaining an easy clean culvert system. The method includes lifting a cover off of a base portion of a culvert section of the culvert system with light weight equipment; removing debris and other blockages from the culvert section; replacing the cover onto the base portion of the culvert section; and repeating the method for other culvert sections of the culvert system, if desired.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to an easy clean culvert system being formed of concrete, wherein the culvert system includes a plurality of culvert sections, each section having a cover that is removably coupled to a base portion of the culvert section. The cover may be removed and replaced in order to access the culvert system for easy cleaning. The culvert sections are coupled together to form the entire culvert system.

Figure 1B:
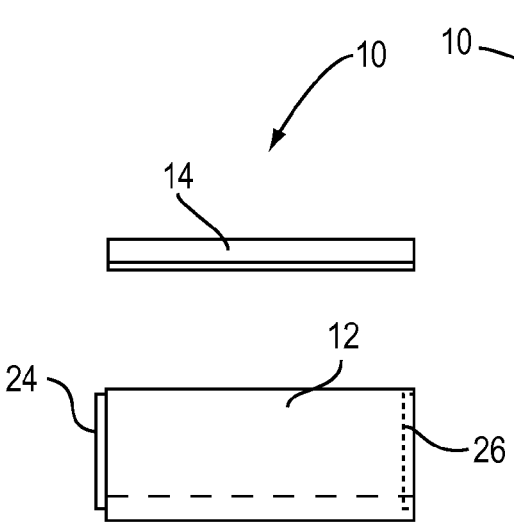
FIG. 1B is a side exploded view of a culvert section of a easy clean culvert system.
Figure 1A:
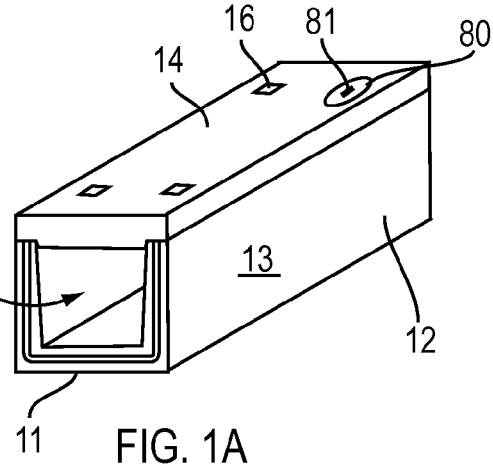
FIG. 1A is a perspective view of a culvert section of a easy clean culvert system.
Figure 2:
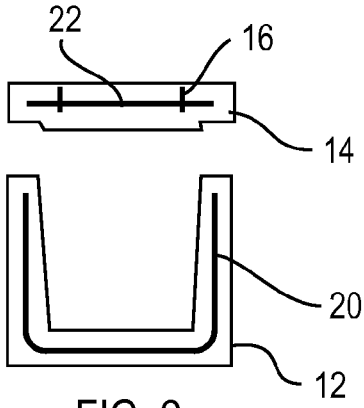
FIG. 2 is a section view of the culvert section of FIG. 1A.

Referring to the drawings, FIGS. 1A-2 show a culvert section 10 of an easy clean culvert system according to particular embodiments of the present invention. The culvert section 10 includes a base portion 12 and a cover 14. The base portion 12 includes bottom wall 11 and two side walls 13, wherein the side walls 13 are parallel to each other and transverse to the bottom wall 11. The cover 14 is removably coupled to the two side walls 13. Accordingly, the cover 14 may be repeatably moveable between a position engaged with and disengaged from the side walls 13. When the cover 14 is coupled to the side walls 13, a passageway 15 is defined between the bottom wall 11, the side walls 13 and the cover 14. The passageway 15 is provided to allow drainage of water there through.

As seen in FIG. 2, the base portion 12 may include reinforcement of the sidewalls 13 and the bottom wall 11 by use of support structure 20. Support structure 20 may be formed within the concrete walls 11 and 13. In particular embodiments, the support structure 20 may include bars in a lattice configuration. In other embodiments other common forms of concrete reinforcement may be utilized. The cover 14 may also be strengthened by use of support structure 22. In other embodiments other common forms of concrete reinforcement may be utilized.

The cover 14 may also include at least one lifting device 16 coupled to the cover 14. The lifting device 16 may include a lifting bolt. In particular embodiments, the cover 14 may include a plurality of lifting devices 16, such as, but without limitation, four lifting devices 16. The lifting device 16 may also be recessed wherein the lifting device 16 does not extend beyond a top surface of the cover 14, thereby preventing damage to vehicle tires that travel over the culvert section 10. Further, the lifting device 16 provides an interface to lift the cover by use of lightweight equipment. This allows for easy cleaning of each culvert section 10 of an easy clean culvert system. According to particular embodiments of the present invention, the lifting device 16 is coupled to the support structure 22. This coupling allows for the lifting of the cover 14 without damaging the concrete of the cover 14. In particular embodiments, the support structure 22 may include bars in a lattice configuration. In particular embodiments of the cover 14, the support structure 22 includes rebar or other metal support upon which the lifting devices 16 may be coupled to through welding. For example, and without limitation, rebar may be used as part of the support structure 22, wherein the lifting device 16 may be a lifting bolt that is welded onto the rebar.

In use, light weight equipment, such a backhoe may have a lifting system that includes chains and means for coupling the chains to the lifting devices 16. Once the lifting system is coupled to the lifting devices, the backhoe may use its bucket to lift the cover. For example, and without limitation, a backhoe may have a chain system removably coupled to its bucket. The chains have nuts that correspond to lift bolts coupled to the cover 14 as the lifting devices 16. The nuts engage the lift bolts 16 and the cover 14 is lifted in response to operation of the backhoe of lifting its bucket.

Further, embodiments of the cover 14 may also include a cap 80 adapted to removably cover the lifting device 16. The cap 80 may be configured to prevent buildup of debris around the lifting device 16 and damage to the lifting device 16. The cap 80 may be a lock cap adapted to prevent unauthorized access to the lifting device 16. The cap 80 may have a key hole 81 configured to receive a corresponding key and unlock in response to activation of the key. The cap 80 is utilized to maintain the lifting device 16 in operable condition as well as limit access to the lifting device 16.

The culvert section 10 may also include a tongue 24 and a keyway 26. One culvert section 10 may be coupled to another culvert section 10 by use of the tongue 24 and the keyway 26. The tongue 24 of one culvert section 10 is coupled to a keyway 26 of another culvert section 10, thereby forming a tongue keyway joint 28, shown in FIGS. 3 and 4.

It will be understood that the size of the culvert sections 10 may vary depending on the intended use of the culvert system. For example, and without limitation, a culvert system used for a roadway may be large in dimension with the ability to support heavy loads of at least 25 tons. Other culvert systems may be used on a smaller scale for uses such as driveways or sidewalks. The function and structure of each is similar, it is merely a differentiation of the scale of the culvert sections 10. Additionally, the culvert sections 10 may vary in length in order to account for the desired length of the culvert system.

It will further be understood that embodiments of the present invention include culvert sections 10 that are smaller in length than what may be required for a culvert system. This allows for ease of manufacture and ease of installation. Additionally, the size of the culvert sections 10 also define the size of the cover 14 and allows the cover 14 to be lifted by lightweight equipment, such as, but not limited to, a front end loader, a backhoe, and the like.

Figure 3:
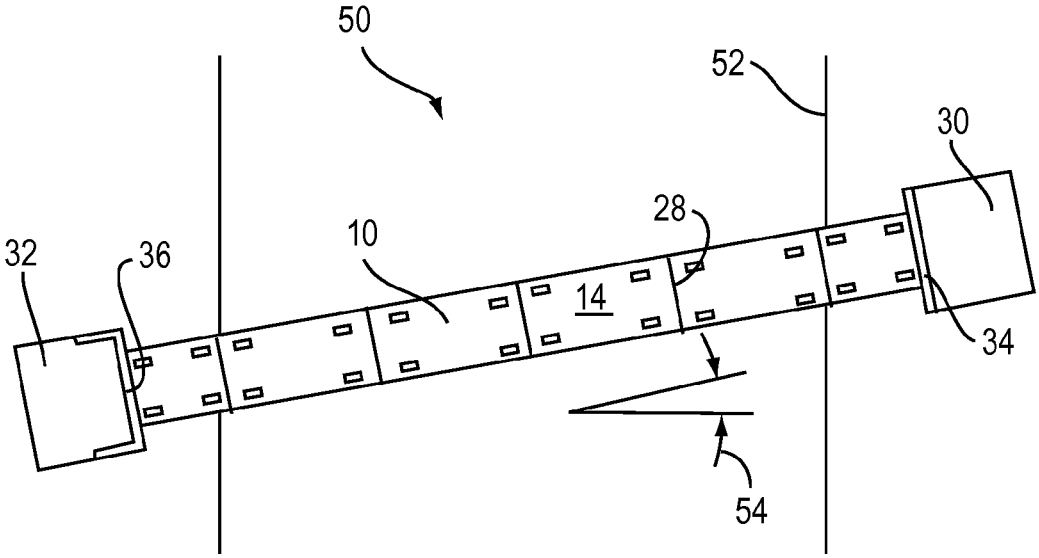
FIG. 3 is a top plan view of a culvert system installed in a roadway.
Figure 4:
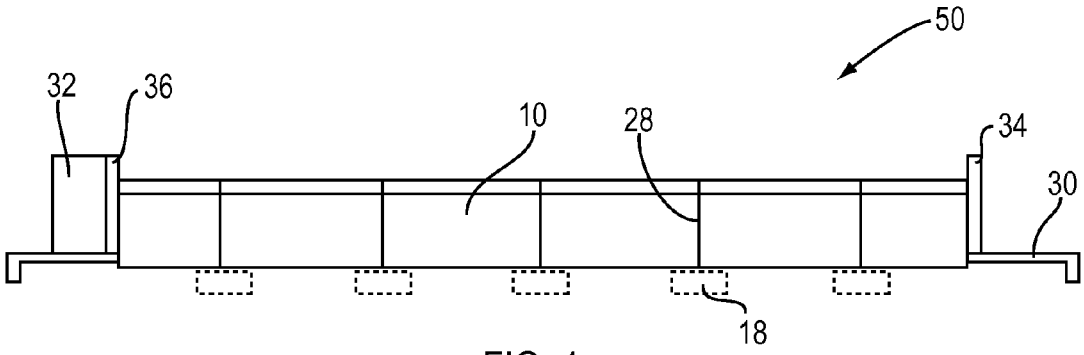
FIG. 4 is a side view of a culvert system installed in a roadway.
Figure 5A:
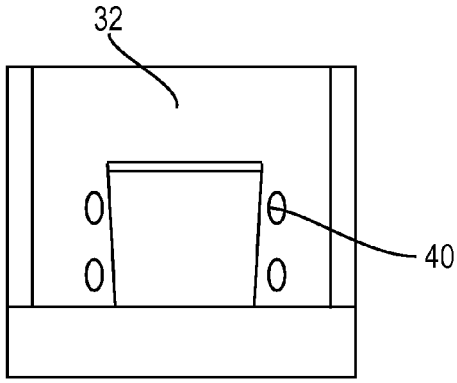
FIG. 5A is a front view of a headwall coupled to a culvert section.
Figure 5B:
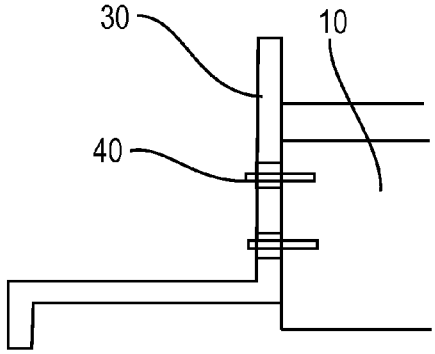
FIG. 5B is a side view of a headwall coupled to a culvert section.

Referring again to the drawings, FIGS. 3-5 depict an easy clean culvert system 50 installed in a roadway. The culvert system 50 may include a plurality of culvert sections 10 coupled together at tongue and keyway joints 28. A head wall 30 or a headwall with wings 32 may be coupled to end culvert sections 10 in order to form a complete culvert system 50. The headwalls 30 and 32 may be coupled to the culvert sections 10 by use of bolts 40, as shown in FIG. 5. The headwall with wings 32 may be used with returns at each end for retainage of slope. The head wall 30 and the head wall 32 each have respective extensions 34 and 36 that extend beyond the cover 14 of the culvert sections 10. The extensions 34 and 36 form a curb portion above the covers 14 of the culvert sections 10. These extensions 34 and 36 may further inhibit debris on the roadway 52 from entering the passageway 15 (see FIG. 1A) and blocking the operation of the culvert system 50.

Figure 6:
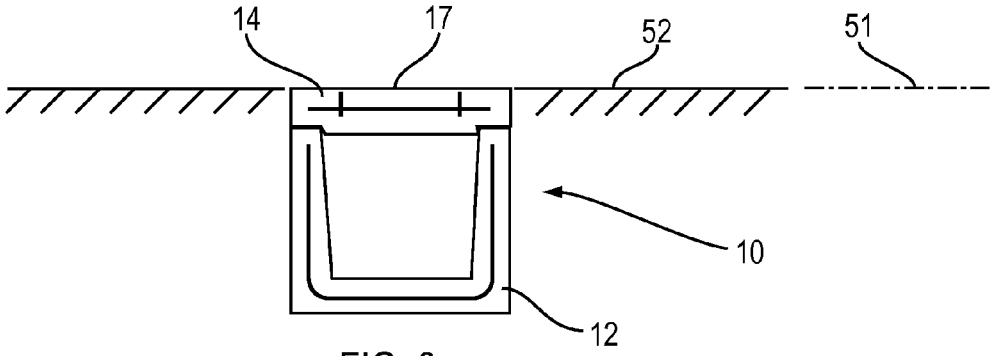
FIG. 6 is an end view of a culvert section within a roadway.

As shown in FIG. 6, the cover 14 of each culvert section 10 may have a top surface 17 that lies within the same plane 51 as roadway 52, wherein the top surface 17 of the cover 14 forms a portion of the roadway 52. The cover 14 is also accessible at all times by lying within the same plane 51 as the roadway 52. This allows for the removal of the cover 14 from the base portion 12 in order to clean debris and silting that is built up in each culvert section 10. It will be understood that the lifting device of each culvert section 10 may be accessible from the roadway 52 and allows the removal and replacement o the cover 14 by use of lightweight equipment such as a front end loader, a backhoe and the like.

In particular embodiments of the present invention, a culvert system may need to be installed in poorly compacted soil or unstable soil. This type of soil provides additional risk to culvert systems, and particularly to the present invention that has culvert sections 10 coupled together. As poor compaction or unstable soil settles, it often settles unevenly or changes unexpectedly. These changes in the soil upon which the culvert system is installed may cause additional shear forces on the culvert system 50. These shear forces would affect the tongue and keyway joints 28 first. The present invention may include bearing blocks 18 in order to provide additional support to the culvert system 50. The bearing blocks 18 may be located beneath each tongue and keyway joint 28, thereby providing additional support to the joint 28 and thereby preventing damage to the culvert system 50 by the application of the additional shear forces.

When installing a culvert system 60 in accordance with embodiments of the present invention, the culvert system 50 may be installed at various skew angles 54. It will be understood that the skew angle 54 may be optimally within a range between 0 and 60 degrees.

Figure 7:
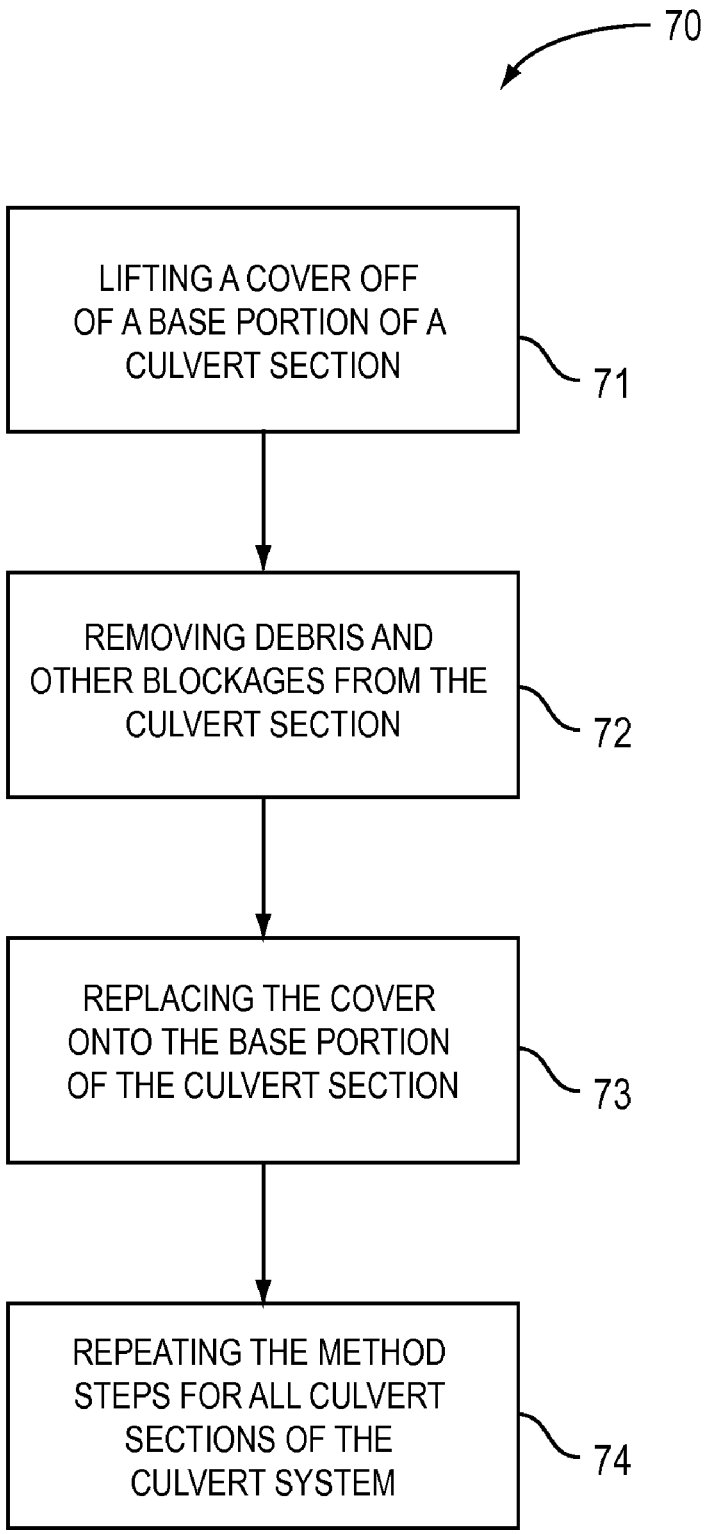
FIG. 7 is a flow chart of a method of maintaining an easy clean culvert system in accordance with the present invention.

Other particular embodiments, as shown in FIG. 7, include a method 70 of maintaining a culvert system in accordance with the present invention. The method 70 may include lifting a cover off of a base portion of a culvert section of the culvert system with light weight equipment (Step 71); removing debris and other blockages from the culvert section (Step 72); replacing the cover onto the base portion of the culvert section (Step 73); and repeating the method steps for all culvert sections of the culvert system (Step 74).

Step 71 of the method 70 may include a prior step of engaging lifting devices of the cover to the light weight equipment. The method 70 may further comprise releasing the lifting devices from the light weight equipment and placing the cover in a location away from the culvert section prior to Step 72. Additionally, the method 70 may also include resecuring the lifting devices to the light weight equipment and replacing the cover on the culvert section. According to particular embodiments of the present invention, Step 72 of removing debris includes utilizing the light weight equipment to remove the debris.

It will be understood that in maintaining the culvert system, the method may be employed to one culvert section or a predetermined number of culvert sections at one time. In so doing, the method may further include diverting traffic to cross the culvert system using culvert sections not being cleaned. This allows for the cleaning of the culvert system without having to stopping traffic on the entire roadway.

Particular embodiments of the present invention may include a method of installing a split box culvert system. The method may include steps of preparing a trench of sufficient size and shape to receive culvert sections; couple a plurality of base portions of culvert sections together within the trench; couple each cover of the plurality of culvert sections onto each culvert section; and couple a head wall onto each end culvert section. The method may further include installing bearing blocks in instances where the soil is unstable.

Other embodiments of the present invention may also include a method of repairing an easy clean culvert system. The method of repairing may include steps of locating a damaged culvert section of the culvert system; removing a cover of the culvert section; removing the damaged culvert section; installing a new culvert section in place of the removed culvert section; and place a cover onto the new culvert section. The method may also include replacing a damaged cover with a new cover.

All text included on the drawing figures of this disclosure are incorporated entirely herein by reference. It will be understood that any measurements provided on the drawing figures and within the text on the drawing figures are present as merely examples of embodiments of the present invention and are not to be considered limitations.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An easy clean culvert system comprising:

a plurality of culvert sections, each culvert section comprising:

a base portion having a bottom wall and two side walls, wherein the side walls are parallel to each other and transverse to the bottom wall;

a cover removably coupled to the base portion, wherein the cover is adapted to be repeatable moveable between positions engaged with and disengaged from the side walls;

at least one lifting device coupled to the cover, wherein the at least one lifting device is configured as an interface to lift the cover by use of lightweight equipment;

at least one cap adapted to removably cover the at least one lifting device, wherein the cap is configured to prevent buildup of debris around the lifting device, and wherein the cap is a lock cap adapted to prevent unauthorized access to the at least one lifting device, the cap having a key hole configured to receive a corresponding key and unlock in response to activation of the key.

2. The culvert system of claim 1, wherein each culvert section of the plurality of culvert sections further comprises a tongue on one end and a keyway on an opposing end, wherein the tongue of one culvert section is coupled to the keyway of another culvert section to form a keyway joint.

3. The culvert system of claim 2, further comprising bearing blocks adapted support the plurality of culvert sections when installed on unstable or poorly compacted soil.

4. The culvert system of claim 3, wherein the bearing blocks are configured to support the culvert system at tongue and keyway joints between each culvert section.

5. The culvert system of claim 1, further comprising headwalls coupled on opposing ends of the culvert system, each headwall having an extension that extends above the cover to form a curb adapted to prevent additional debris from falling into the culvert system.

6. An easy clean culvert section comprising:

at least one culvert section adapted to support at least twenty-five tons, the culvert section comprising:

a base portion having a bottom wall and two side walls, wherein the side walls are parallel to each other and transverse to the bottom wall;

a cover removably coupled to the base portion, wherein the cover is adapted to be removed for cleaning of the culvert section and replaced when cleaning is complete;

lifting devices coupled to the cover adjacent each corner of the cover, wherein the lifting devices are configured as an interface to lift the cover by use of lightweight equipment;

at least one cap adapted to removably cover the at least one lifting device, wherein the cap is configured to prevent buildup of debris around the lifting device and wherein the cap is a lock cap adapted to prevent unauthorized access to the at least one lifting device, the cap having a key hole configured to receive a corresponding key and unlock in response to activation of the key; and a roadway, wherein a top surface the cover of the culvert section lies substantially within a same plane as the roadway surface.

7. The culvert system of claim 6, wherein the at least one culvert section is a plurality of culvert sections, each culvert section of the plurality of culvert sections further comprising a tongue on one end and a keyway on an opposing end, wherein the tongue of one culvert section is coupled to the keyway of another culvert section to form a keyway joint.

8. The culvert system of claim 7, further comprising bearing blocks adapted support the plurality of culvert sections when installed on unstable or poorly compacted soil.

9. The culvert system of claim 8, wherein the bearing blocks are configured to support the culvert system at tongue and keyway joints between each culvert section.

10. The culvert system of claim 6, further comprising headwalls coupled on opposing ends of the culvert system, each headwall having an extension that extends above the cover to form a curb adapted to prevent additional debris from falling into the culvert system.

* * * * *

UNITED STATES PATENT AND TRADEMARK OFFICE

CERTIFICATE OF CORRECTION

PATENT NO. : 7,530,764 B1
APPLICATION NO. : 12/107586
DATED : May 12, 2009
INVENTOR(S) : Joe Gallegos It is certified that error appears in the above-identified patent and that said Letters Patent is hereby corrected as shown below:

Col. 6 line 30 should read as follows;

--. . .adapted to be repeatably moveable. . .--

Signed and Sealed this

Twenty-third Day of June, 2009

JOHN DOLL
*Acting Director of the United States Patent and Trademark Office*